US008678447B2

(12) United States Patent
Chin

(10) Patent No.: US 8,678,447 B2
(45) Date of Patent: Mar. 25, 2014

(54) DRILL PIPE SYSTEM

(75) Inventor: David Chin, Cypress, TX (US)

(73) Assignee: National Oilwell Varco, L.P., Houston, TX (US)

( * ) Notice: Subject to any disclaimer, the term of this patent is extended or adjusted under 35 U.S.C. 154(b) by 414 days.

(21) Appl. No.: 12/784,829

(22) Filed: May 21, 2010

(65) Prior Publication Data

US 2010/0308577 A1 Dec. 9, 2010

Related U.S. Application Data

(60) Provisional application No. 61/183,973, filed on Jun. 4, 2009.

(51) Int. Cl.
*E21B 17/02* (2006.01)

(52) U.S. Cl.
USPC ..... 285/333; 285/334

(58) Field of Classification Search
USPC ..... 285/333, 334
See application file for complete search history.

(56) References Cited

U.S. PATENT DOCUMENTS

| | | | | |
|---|---|---|---|---|
| 570,166 | A | 10/1896 | Greenfield | |
| 590,811 | A | 9/1897 | Storrow | |
| 1,909,075 | A | 5/1933 | Ricker et al. | |
| 2,040,766 | A | 5/1936 | Chappell | |
| 2,086,151 | A | 7/1937 | Bannerman | |
| 2,233,734 | A | 3/1941 | Ely et al. | |
| 2,487,241 | A | 11/1949 | Hilton | |
| 2,805,872 | A | 9/1957 | Routh | |
| 3,067,593 | A * | 12/1962 | McCool | 464/183 |
| 3,253,841 | A | 5/1966 | Ahmad | |
| 3,266,821 | A | 8/1966 | William | |
| 3,482,007 | A | 12/1969 | Routh | |
| 3,822,902 | A * | 7/1974 | Maurer et al. | 285/94 |

(Continued)

FOREIGN PATENT DOCUMENTS

| | | | |
|---|---|---|---|
| GB | 641125 | A | 8/1950 |
| GB | 2032033 | A | 4/1980 |

OTHER PUBLICATIONS

NOV Grant Prideco, "Drilling Products and Services", http://www.nov.com/uploadedFiles/Business_Groups/Grant_Prideco/Drilling_Tubulars/Catalog/NOV%20Grant%20Prideco%20-%20Drilling%20Products%20Catalog%20-%20Rev2.pdf, Feb. 2008, pp. 1-119.*

(Continued)

*Primary Examiner* — James Hewitt
(74) *Attorney, Agent, or Firm* — The JL Salazar Law Firm

(57) ABSTRACT

A tubular threaded connection for coupling drill pipe segments to form a drill string is provided. Each of the segments has a tubular pipe body having a wall thickness of >0.5 inches (1.27 cm). The threaded connection comprises a pin end with an external thread, and a box end with an internal thread for threadable engagement with the external thread of the pin end. The pin shoulder extends between a pin base diameter and an outer pin bevel diameter; the box shoulder extends between a box base diameter and an outer box bevel diameter. The outer pin and box bevel diameters are between 7.75-8.688 inches (19.05-21.59 cm). The pin and box shoulders define a contact area such that, when the pin and box ends are threaded together with a make-up torque of >75,000 ft-lbs (1,079.36 kg-m), a load capacity of >2.0 million lbs (908,000 kg) is provided.

14 Claims, 11 Drawing Sheets

(56) References Cited

U.S. PATENT DOCUMENTS

| | | | |
|---|---|---|---|
| 4,269,437 | A | 5/1981 | Shaw et al. |
| 4,400,019 | A | 8/1983 | Fruck |
| 4,496,173 | A | 1/1985 | Roche et al. |
| 4,509,776 | A | 4/1985 | Yoshida et al. |
| 4,550,936 | A | 11/1985 | Haeber et al. |
| 4,568,113 | A | 2/1986 | Axford et al. |
| 4,600,219 | A | 7/1986 | Yoshida et al. |
| 4,671,544 | A | 6/1987 | Ortloff |
| 4,679,831 | A | 7/1987 | Kielminski |
| 4,703,959 | A | 11/1987 | Reeves et al. |
| 4,786,090 | A | 11/1988 | Mott |
| 4,856,828 | A | 8/1989 | Kessler et al. |
| 4,921,282 | A | 5/1990 | Meisinger |
| 5,029,906 | A | 7/1991 | Chelette et al. |
| 5,069,485 | A | 12/1991 | Allen et al. |
| 5,224,738 | A | 7/1993 | Taga |
| 5,236,230 | A | 8/1993 | Mudge, Jr. et al. |
| 5,282,652 | A | 2/1994 | Werner |
| 5,406,983 | A | 4/1995 | Chambers et al. |
| 5,470,111 | A | 11/1995 | Nelson et al. |
| 5,505,464 | A | 4/1996 | McGarvey |
| 5,535,837 | A | 7/1996 | Carlin |
| 5,779,276 | A | 7/1998 | Allen |
| 5,853,199 | A | 12/1998 | Wilson |
| 5,908,212 | A | 6/1999 | Smith et al. |
| 6,012,744 | A | 1/2000 | Wilson et al. |
| 6,036,235 | A | 3/2000 | Anderson et al. |
| 6,050,610 | A | 4/2000 | Enderle et al. |
| 6,312,024 | B1 | 11/2001 | Dutilleul et al. |
| 6,447,025 | B1 | 9/2002 | Smith |
| 6,811,189 | B1 | 11/2004 | DeLange et al. |
| 6,832,502 | B1 | 12/2004 | Whyte et al. |
| 6,863,313 | B1 | 3/2005 | DeLange et al. |
| 6,869,080 | B2 | 3/2005 | Janoff et al. |
| 7,107,662 | B1 | 9/2006 | Levario |
| 7,114,751 | B2 | 10/2006 | Reynolds, Jr. |
| 7,225,523 | B2 | 6/2007 | Metcalfe |
| 7,360,797 | B2 | 4/2008 | Posson |
| 2002/0017788 | A1 * | 2/2002 | Krug et al. ..... 285/333 |
| 2002/0130515 | A1 | 9/2002 | Mlyajima et al. |
| 2005/0151369 | A1 | 7/2005 | Baruh |
| 2005/0173919 | A1 | 8/2005 | Posson |
| 2008/0073905 | A1 | 3/2008 | McLaughlin |
| 2009/0008929 | A1 | 1/2009 | Person |

OTHER PUBLICATIONS

"The Duoline Lining Process stops corrosion where other systems fail. Riceline is protected tubing that's ready to install.," Duoline Lining and Riceline Tubing for internal corrosion resistance, Mar. 1995, Rice Engineering Corporation; pp. 1-4.

"Duoline 20 Chemical Resistance Chart," Duoline HT2 Fiberglass—Epoxy Lining for High Temperatures Double Lined Steel Pipe and Tubing, Dec. 1985, Rice Engineering Operating Ltd.; pp. 1-2.

"Table 3.7.9 Used Tool Joint Acceptance Criteria Thick-wall Drill Pipe," DS-1 Drill Stem Inspection, Jan. 2004, vol. 3, TH Hill Associates, Inc.; pp. 123-124.

"Premium Corrosion Protection for Oilfield Tubulars, Duoline Stops Corrosion . . . Reduces Cost", (with transcription) Rice Engineering Corporation; 1995, 10 pages.

Duoline 10-PE, brochure from Duoline Technologies, May 2005, [online], Retrieved on Sep. 4, 2012, Retrieved from the Duoline Technologies website using Internet <URL:http://www.duoline.com/web_size_img/PDF/Duoline10PE.pdf>.

Duoline 30, brochure from Duoline Technologies, Jul. 15, 2003 [online], Retrieved on Sep. 4, 2012, Retrieved from the Duoline Technologies website using Internet <URL:http://www.maxtube.com/pdf/products/duoline30_brochure.pdf>.

* cited by examiner

DRILL PIPE SYSTEM

CROSS REFERENCE TO RELATED APPLICATION

This application claims the benefit of U.S. Provisional Application No. 61/183,973, filed Jun. 4, 2009, the entire contents of which are hereby incorporated by reference.

BACKGROUND OF THE INVENTION

The present invention relates generally to techniques for performing oilfield operations at a wellsite. More specifically, the present invention relates to techniques for configuring drill pipe for use in the drilling of a wellbore at the wellsite. Such drill pipe may involve, for example, tubular threaded connections on drill pipe, drill collars and/or tool joints that incorporate tapered threads between a radially outward shoulder and a radially inward shoulder, commonly referred to as a rotary shouldered (or threaded) connection.

Oilfield operations are typically performed to locate and gather valuable downhole fluids. Oil rigs are positioned at wellsites, and downhole tools, such as drilling tools, are deployed into the ground to reach subsurface reservoirs. Drill pipe strings (or drill strings), which comprise multiple drill pipes threadably connectable to one another, are typically suspended from the oil rig and used to advance a drilling tool into the Earth to drill subterranean wells. These drill pipes (or drill pipe sections) typically have tool joints (or connections) welded at each end and connected to each other to form the drill string. When drill pipe is used to drill subterranean wells, the drill pipes (or drill pipe sections) are often exposed to bending, torsional, and/or other stresses.

Oil and gas producers are attempting to drill deeper and deeper wells as they strive to maintain or increase their reserves of oil and gas. Wells 10,000 (3,050 m) to 15,000 ft. (4,575 m) deep have been common for many years. Today, wells 28,000 (8,540 m) to 30,000 ft. (9,150 m) deep are becoming more commonplace. In order to achieve the greater depths, drill pipe configurations may need to be adapted to operate in the extreme conditions. Drill pipe configurations with a wall thickness greater than 0.500" (12.7 mm) are commonly referred to as landing strings. The landing strings are typically designed to provide high tensile capacity that far exceeds the standard capacities of American Petroleum Institute (API) strings. A primary purpose may be to provide high tensile capacity for landing heavy wall casing for deepwater drilling. By using a rotary shoulder connection, the speed and robust design may increase efficiency by using the same rig handling equipment for drilling.

Up until about 2009, the tensile capacity of a landing string was typically less than about 2.0M lbs (908,000 kg). However, new requirements of the tube body have been targeted to achieve a load capacity of about 2.5M lb (1,135,000 kg). With 2.5M lbs. (1,135,000 kg) load capacity, a new connection is typically needed in order to exceed the stress levels at this higher load. The 2.0M lbs. (908,000 kg) landing strings have been successfully manufactured and deployed. However, operators may need to adjust the configuration to reach ever-increasing depths requiring landing strings with increased setting capacity. Drilling rigs, top drives and associated equipment with capacity of 1,250 tons (1,133 metric tons) are being developed. Landing strings with 2.5 M lbs. (1,135,000 kg.) capacity may be required by the drilling industry.

The standard 6-⅝" (16.83 cm) FH connection with API bevel diameter (referred to herein as the Standard FH Connection) may no longer be able to maintain the connection integrity required at these levels. FIG. 1A shows such a stress distribution on a conventional connection 148 (or rotary shoulder connection) with a counterbore area 152. FIG. 1B shows a cross-sectional view of a conventional pin end 140 of the conventional connection. As shown the pin end is a Standard FH Connection. The conventional pin end 140 has a primary shoulder 150 that is configured to engage a conventional box end 142, as shown in FIG. 1A. The area of the primary shoulder 150 of the conventional pin end 140 is defined by the area between a standard bevel diameter and a standard box counterbore diameter. The bevel diameter of the Standard FH Connection is 7.703" (19.56 cm) and the standard box counterbore diameter is 6.836" (17.363 cm). FIGS. 1A and 1B show a standard bevel radius (SRb) 154 (or ½ of the standard bevel diameter) and a standard box counterbore radius (SRbm) 156 (or ½ of the standard box counterbore diameter). The Standard FH Connection has the SRb 154 of 3.852" (9.78 cm) and the SRbm 156 of 3.418 (8.68 cm).

As shown in FIG. 1A at a make-up torque of 80,000 ft-lb. (11,070 Kg-m) the conventional connection may be over-stressed upon make-up. An over-stressed cross-hatched section 155 of the conventional box end 142 is shown to cross the box end 142 at about a 45° angle to the conventional box end 142. The over-stressed cross hatched section 155 is shown on a legend 157 as being represented by the letter A. The stress levels in the legend 157 decrease from A to H as shown on the legend 157 and represented on the conventional connection in FIG. 1A.

Attempts have been made to provide pipe and joint configurations as described, for example, in U.S. Pat. Nos. 6,447,025; 6,012,744; 5,908,212; 5,535,837; and 5,853,199. Despite the development of various techniques for providing pipe joints, there remains a need to provide a drill pipe particularly suitable for applications on drill pipe used in drilling deep wells and/or having a greater tensile capacity. It is desirable that such drill pipe be configured for applications involving pipe configurations with a wall thickness greater than 0.5" (12.7 mm.). It is further desirable that such drill pipe be configured for applications involving pipe configurations with a tensile capacity of more than 2.5 M lb (1,135,000 kg.). Preferably, such drill pipe is capable of one or more of the following, among others: increased tensile strength, decreased stress levels, conformed to API standards, increased MUT, and reduced failure. The present invention is directed to fulfilling these needs in the art.

BRIEF DESCRIPTION OF THE DRAWINGS

So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are, therefore, not to be considered limiting of its scope, for the invention may admit to other equally effective embodiments. The Figures are not necessarily to scale and certain features and certain views of the Figures may be shown exaggerated in scale or in schematic in the interest of clarity and conciseness.

DETAILED DESCRIPTION OF THE INVENTION

The description that follows provides exemplary apparatus, methods, techniques, and instruction sequences that embody techniques of the present inventive subject matter. However, it is understood that the described embodiments may be practiced without these specific details.

Figure 2:
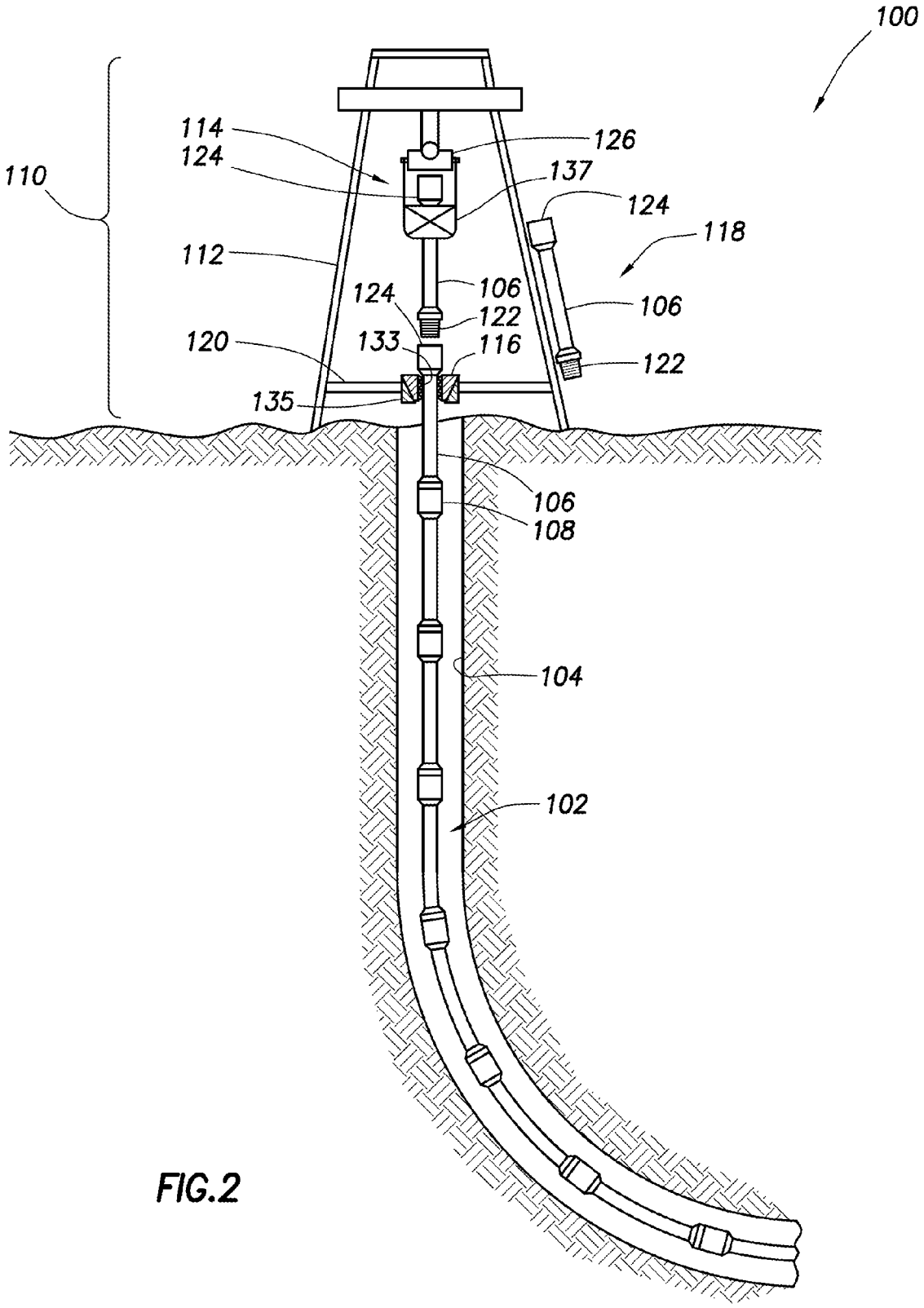
FIG. 2 shows a schematic view of a wellsite having a drill string suspended from an oil rig for advancing a drilling tool into the Earth to form a wellbore, the drill string having a plurality of modified drill pipe segments joined together by tubular threaded connections.

FIG. 2 depicts a schematic view of a wellsite 100 for running a drill string 102 into a wellbore 104. The drill string 102 may include a plurality of drill pipe segments 106 (or drill pipe or pipe joint) coupled together at a tubular threaded connection 108. The tubular threaded connection 108 may have various high capacity pipe features, such as an increased bevel diameter, in order to increase the loading capacity of the drill string 102 as will be described in more detail below.

A surface system 110 may couple and convey the plurality of drill pipe segments 106 into the wellbore 104. The surface system 110 may include a rig 112, a hoisting system 114, a set of slips 116 and a pipe stand 118. The set of slips 116 (with slip inserts 133 and bowl 135) may support the drill string 102 from a rig floor 120 while the hoisting system 114 engages the next drill pipe segment 106 from the pipe stand 118. The hoisting system 114 may then locate a pin end 122 over a box end 124 (or box) of an uppermost pipe (or tubular) of the drill string 108 held by the slips 116. The pin end 122 of the suspended drill pipe segment 106 may then be located in the box end 124 of the uppermost pipe in the drill string 102. A make up unit 126 (with elevator bushings 137) may then apply torque to the suspended drill pipe segment 106 in order to couple the pin end 122 to the box end 124. The increased bevel diameter may reduce the stress in the tubular threaded connection 108 even at a high make up torque (MUT). Although, the rig 112 is shown as a land based rig, the rig 112 may also be a water based rig.

The drill string 102 may be made up of varying types of drill pipe segments 106. For example, the drill string 102 may be a combination of tubulars such as drill pipe, casing, landing strings, cross-over subs, and the like. In order to increase the tensile capacity of the drill string 102, many of the drill pipe segments 106 may be required to be landing strings. As stated above, landing strings are drill pipe segments having a wall thickness that is greater than 0.50 inches (12.7 cm). Landing strings may be needed in order to exceed stress levels at higher loads, such as the 2.5M lbs (1,135,000 kg) load.

Figure 3A:
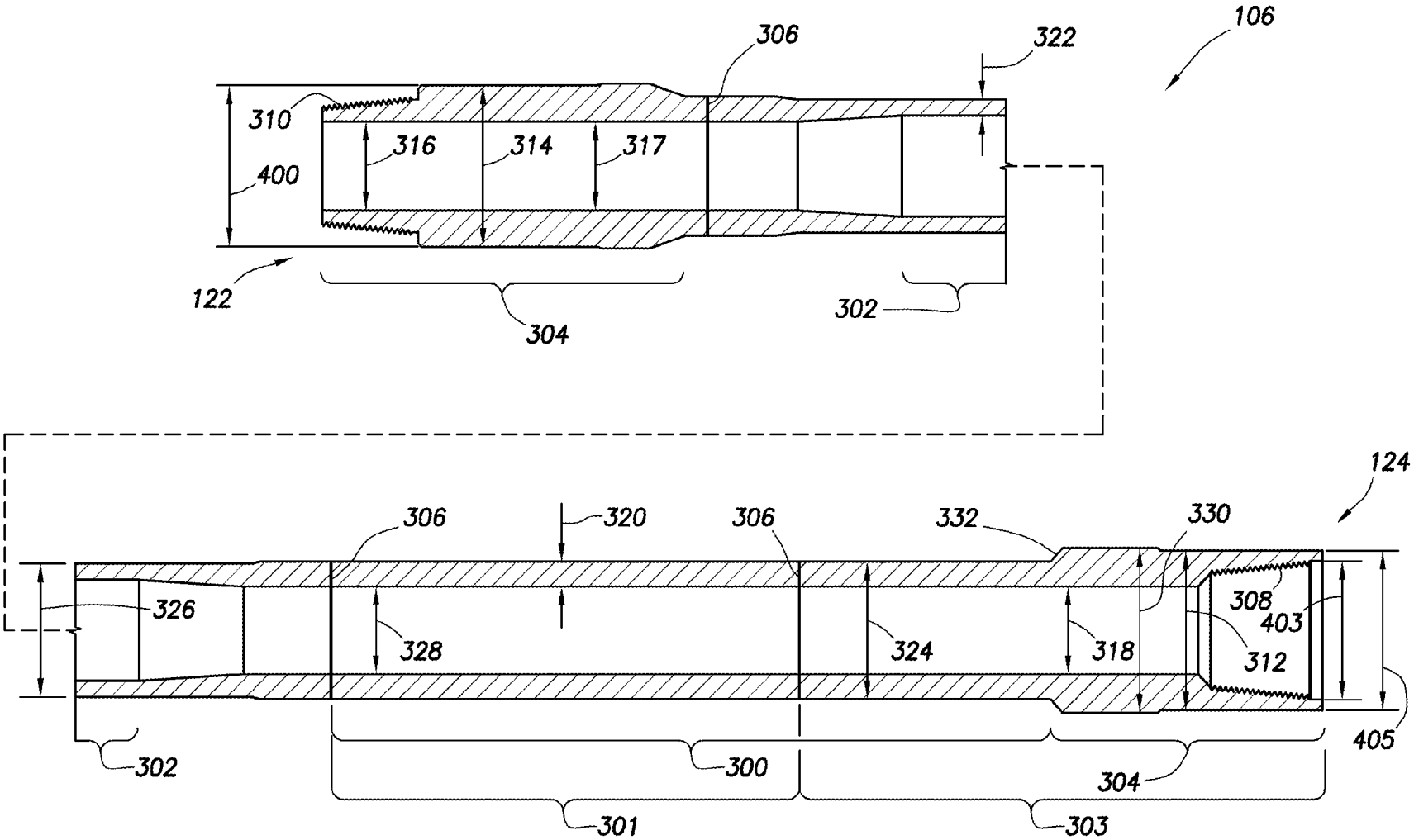
FIG. 3A shows a cross-sectional view of a modified drill pipe (or drill pipe segments) of the drill string of FIG. 2.
Figure 3B:
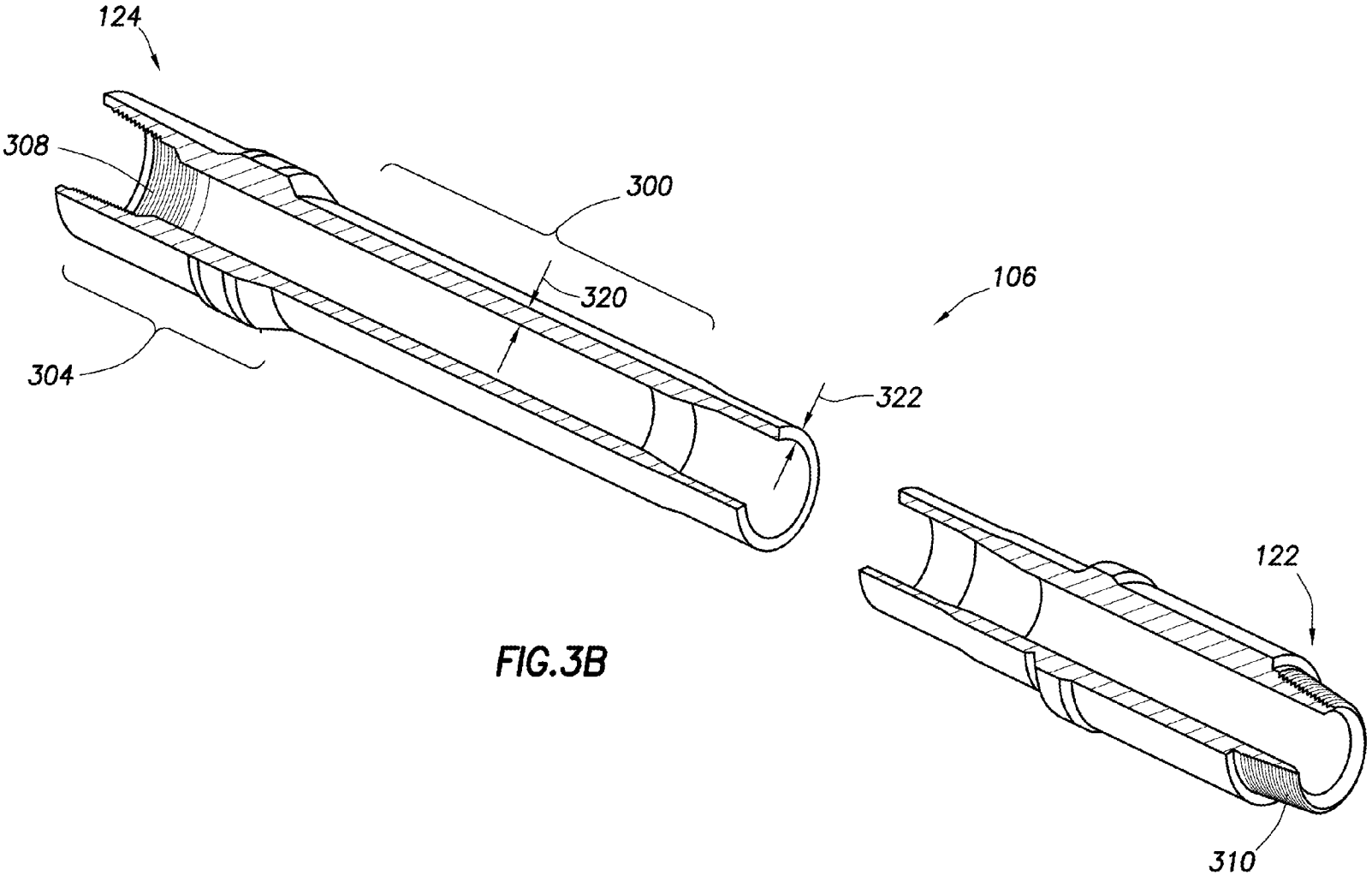
FIG. 3B shows a schematic, cut away view of the modified drill pipe segments of the drill string of FIG. 2.
Figure 3C:
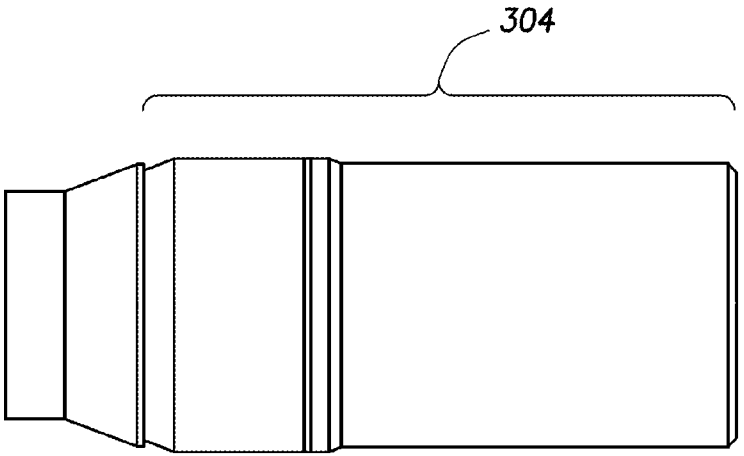
FIG. 3C shows a schematic view of a box end of the modified drill pipe segments of the drill string of FIG. 2.
Figure 3D:
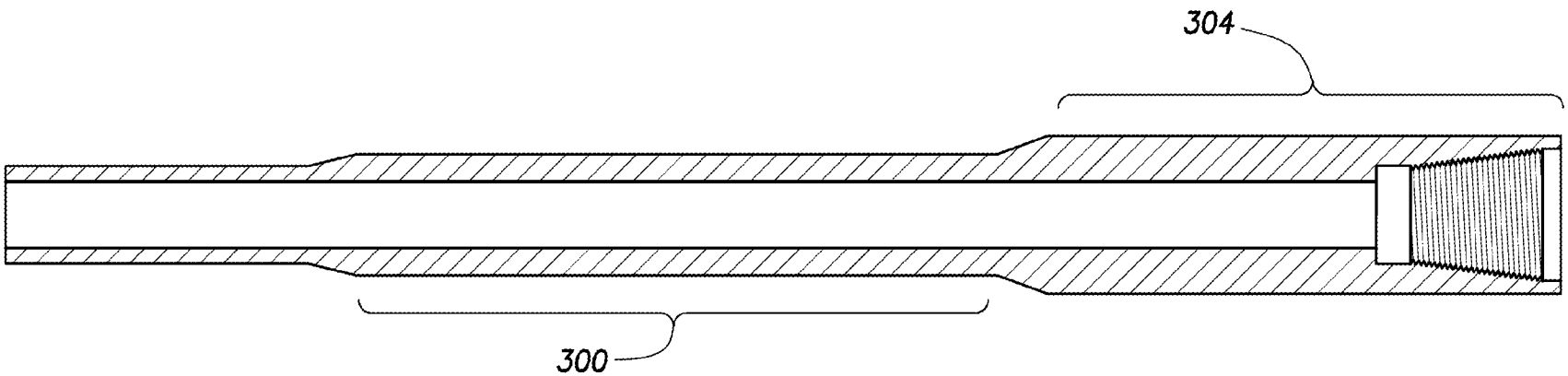
FIG. 3D shows a cross-sectional view of a portion of the modified drill pipe segments of the drill string of FIG. 2.

The drill pipe segments 106 and/or the tubular threaded connection 108 may be modified in several ways from standard drill pipe in order to increase the loading capacity of the drill string 102. FIGS. 3A-3D show various views of a modified drill pipe segment. FIGS. 3A and 3B show a cross-sectional view and a schematic cut away view of the drill pipe segment 106, respectively. FIGS. 3C and 3D show schematic and cross-sectional views, respectively, of a portion of the modified drill pipe. The modified drill pipe segment may be provided with various high capacity pipe features that may be used to increase, for example the loading capacity of the drill string 102 (as shown in FIG. 2). Although FIG. 3A shows these high capacity pipe features as being used in combination with one another, each of the high capacity pipe features may be used independently of one another. The high capacity pipe features may comprise, for example, the tubular threaded connection 108 (when used in combination as shown in FIG. 2), a slip section 300, a plain end section 301, a tool joint section 303, a tubular body 302, a tool joint 304, and one or more welds 306 adjusted for use in applications involving, for example, high stress and/or loads. The slip section 300 may have an inner diameter (SSID) 328, an outer diameter (SSOD) 324 a wall thickness (SSWT) 320. The tool joint 304 may have a tapered tool joint shoulder 332, and a tool joint outer diameter (ODtj) 330. The tubular body 302 may have a pipe body wall thickness (PBWt) 322 and an outer diameter (PBOD) 326.

The tubular threaded connection 108 comprises the pin end 122 threadedly connected to the box end 124 of an adjacent drill pipe segment in the drill string 102 (see, e.g., FIG. 2). The box end 124 may have an internal thread 308 configured to mate with an external thread 310 of the pin end 122 (or tubular pin) of the next drill pipe segment 106, as shown in FIG. 3A. In high capacity drill pipe when compared to standard drill pipe, various diameters may be increased at several locations along the drill pipe segment 106. Further, when compared to a standard drill pipe segment, an inner diameter may be decreased at several locations along the high capacity drill pipe segment 106. For example, a box end connection outer diameter (ODbc) 312 (see e.g., FIG. 3A) may be increased in order to increase the robustness of the tubular threaded connection 108. Further, a pin end connection outer diameter (ODpc) 314 may be increased in order to increase the robustness of the tubular threaded connection 108.

Figure 4A:
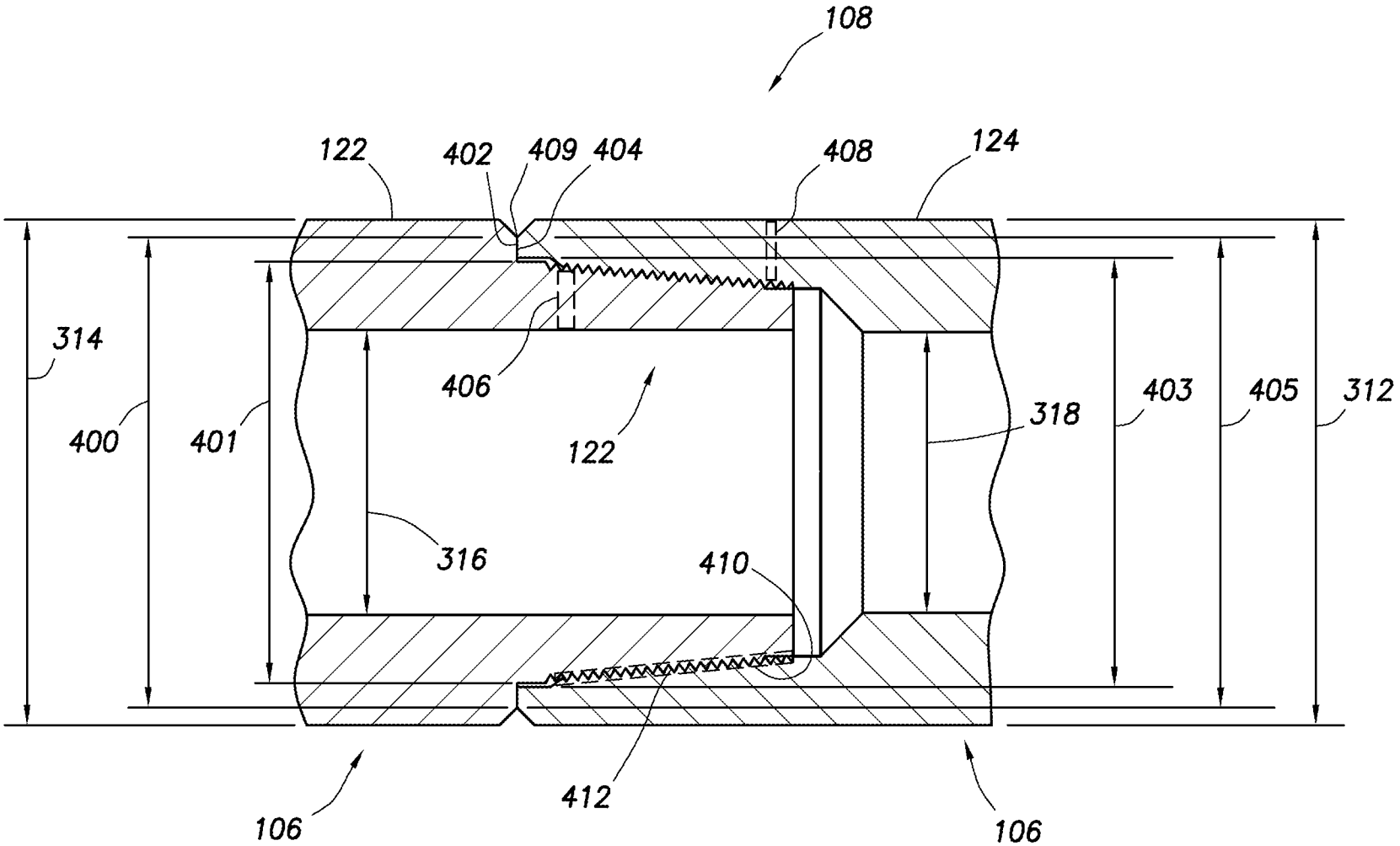
FIG. 4A shows a cross-sectional view of a portion of the threaded tubular connection of the drill string of FIG. 2.
Figure 4B:
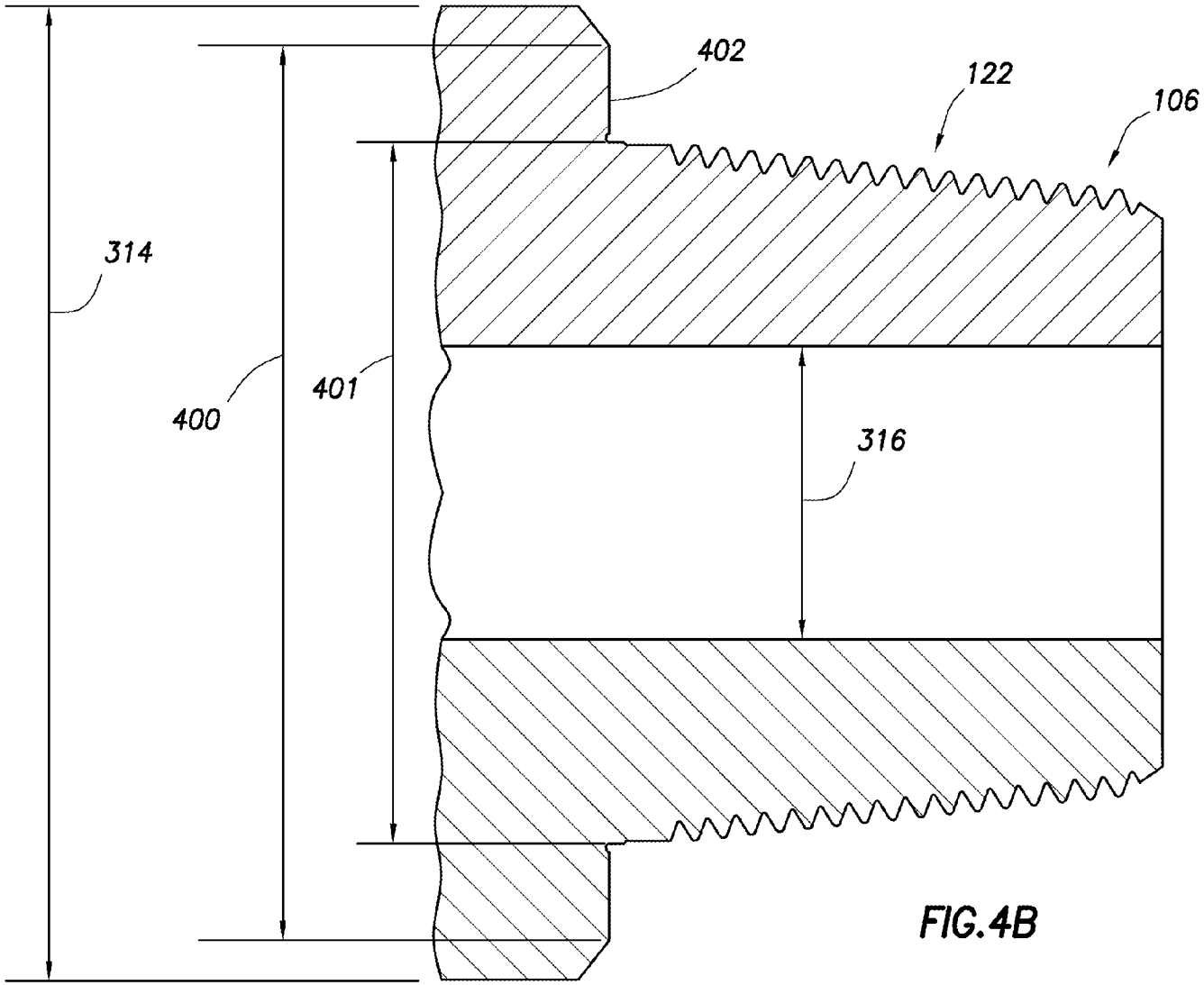
FIG. 4B shows a cross-sectional view of a portion of the pin end of the modified drill pipe segments of FIG. 3A.
Figure 4C:
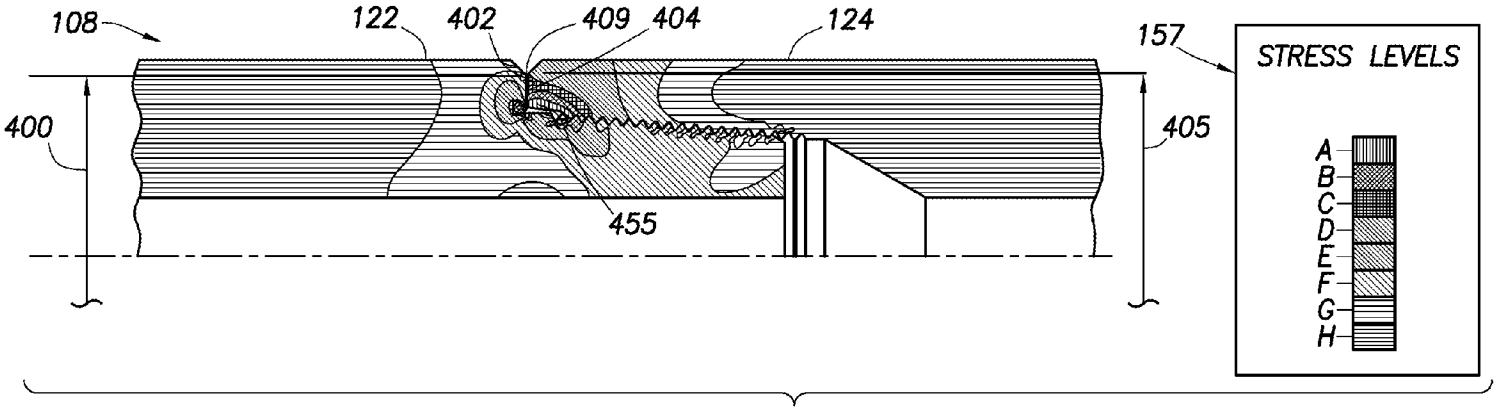
FIG. 4C shows cross-sectional view depicting a stress distribution across a portion of the threaded tubular connection of the drill string of FIG. 2.
Figure 4D:
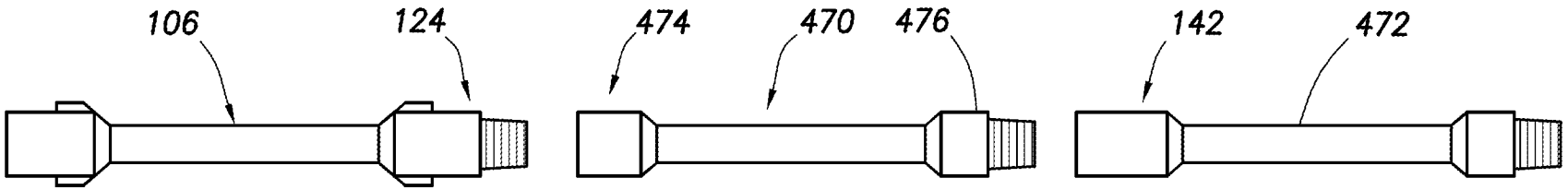
FIG. 4D shows a schematic view of the modified drill pipe segments of FIG. 3A, a cross-over sub and the standard drill pipe segments of FIG. 1A.

FIGS. 4A-4D depict various aspects of the high capacity features as provided in the modified drill pipe segment. FIG. 4A shows a portion of a threaded tubular connection 108 of two adjacent drill pipe segments 106; FIG. 4B details a pin end 122 of the drill pipe segment 106; FIG. 4C depicts the stresses across the threaded tubular connection 108; and FIG. 4D depicts a modified drill pipe segment coupled with a standard drill pipe segment.

As shown in FIG. 4A, the pin end connection outer diameter (ODpc) 314 may be substantially the same as the box end connection outer diameter (ODbc) 312. Although the ODpc 314 and the ODbc 312 are shown as being substantially similar in size, the ODpc 314 and the ODbc 312 may have varying sizes depending on design parameters. When the drill pipe segment 106 is a modified Standard FH Connection (referred to herein as the Modified FH Connection), the ODpc 314 and the ODbc 312 may be greater than 8.5" (21.59 cm). In one example, the ODpc 314 and the ODbc 312 may be substantially equal and may be, for example, about 8.688" (22.067 cm). The threaded connection may define a pin critical area 406, a box critical area 408, a threaded shear area 410 and a threaded bearing area 412.

The inner diameter of the drill pipe segment 106 may also be modified at several locations in order to increase the robustness of the drill pipe segment 106 and/or the tubular threaded connection 108. A pin end connection inner diameter (IDpc) 316, as shown in FIG. 3A, may be decreased in order to increase the robustness of the tubular threaded connection 108. As shown in FIG. 4A, the pin end connection inner diameter (IDpc) 316 may be substantially the same as a box end connection inner diameter (IDbc) 318. Although the IDpc 316 and the IDbc 318 are shown as being substantially similar in size, the IDpc 316 and the IDbc 318 may have varying sizes depending on design parameters. When the drill pipe segment 106 is a Modified FH Connection, the IDpc 316 and the IDbc 318 may be less than 4.0" (10.16 cm). In one example, the IDpc 316 and the IDbc 318 may be substantially equal and may be about 3.5" (8.89 cm).

The tubular threaded connection 108 may also have an increased bevel diameter (Db) 400 as shown in FIGS. 4A and 4B. The increased bevel diameter (Db) 400 provides the threaded tubular connection 108 with a pin shoulder 402 (or radially outward shoulder) having an increased area when compared to the standard API drill string. The pin shoulder 402 is defined by the area between the increased bevel diameter Db 400 and a pin base diameter (Dbm) 401. The Db 400 for the Modified FH Connection may be, for example, between about 7.75" (19.685 cm) and 8.688" (22.067 cm). In another example, the Db 400 for the modified FH connection may be, for example, between about 8.0" (20.32 cm) and 8.1" (20.574 cm). In one example, the Db 400 and/or Db 405 may be substantially equal to about 8.078" (20.518 cm). The pin base diameter Dbm 401 may be substantially equal to 6.674" (16.952 cm). The Db 400 of the pin end 122 may be substantially similar to the Db 405 of the box end 124, as shown in FIG. 4A. Further, the Db 400 for the pin end 122 and the Db 405 for the box end 124 may vary.

The box end 124 may have a box shoulder 404 (or radially inward shoulder) configured to engage the pin shoulder 402 when the box end 124 mates with the pin end 122. The box shoulder 404 is defined by the area between the bevel diameter Db 405 of the box end and a box counterbore diameter (BDbm) 403 (as shown in FIGS. 3A and 4A). The box shoulder 404 may be substantially similar to the pin shoulder 402. The box counterbore diameter (BDbm) 403 may be, for example, 6.836" (17.363 cm) in one example. A contact area 409 between the pin shoulder 402 area and the box shoulder 404 area are preferably configured to distribute the compressive forces created by the make-up torque about the threaded tubular connection 108.

Figure 1A:
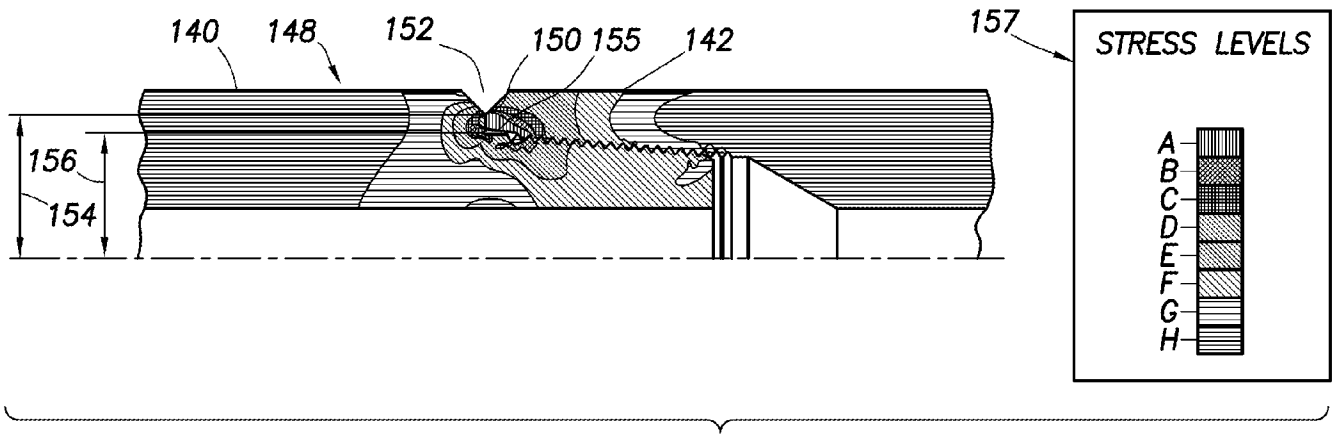
FIG. 1A (PRIOR ART)
FIG. 1A is a cross-sectional view of a conventional threaded tubular connection depicting a stress distribution across a portion of a conventional pin end and a conventional box end thereof.
Figure 1B:
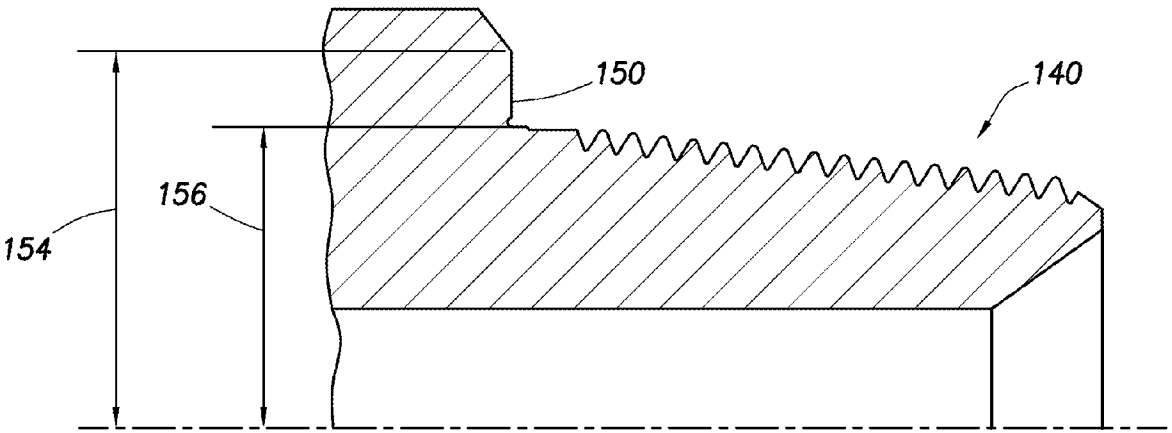
FIG. 1B (PRIOR ART)
FIG. 1B is a cross-sectional view of the conventional pin end of the conventional threaded tubular connection of FIG. 1A.

FIGS. 1A and 4C depict stress distributions across standard and modified drill pipe segments, respectively. FIG. 4C depicts stress distribution across the threaded tubular connection 108 in landing strings using the increased bevel diameter Db 400, 405 and thereby an increased contact area 409 therebetweeen. The increased, or enlarged, bevel diameter may be used on drill strings having an increased tensile capacity of greater than or equal to 2.0 M lbs (908,000 kg). Normally, API rotary shoulder connections (RSC) are selected for landing strings. The Standard FH Connection on a properly sized drill pipe segment typically provides adequate tensile strength. However, the standard (RSC) connection may yield upon makeup due to the compressive forces created between the conventional box end 142 and the conventional pin end 140, as shown in FIG. 1A. The increased bevel diameter Db 400 and increased area of the pin shoulder 402, and the increased bevel diameter Db 405 and increased area of the box shoulder 404 as depicted in FIGS. 4A-C are designed to decrease the stress in the modified tubular threaded connection 108 upon make-up and to prevent shoulder separation with the higher make-up torque.

For the standard rotary shoulder connection 148 (or the Standard FH Connection 148) at 80,000 ft-lbs (11,070. Kg-m) and 78,000 ft-lbs (10,793 Kg-m) of makeup torque as shown in FIG. 1A, the bearing stress at the primary shoulder 150 may exceed the minimum yield strength of the material. This extreme bearing stress may also lead to galling of the primary shoulder 150 and deformation of a counterbore area 152. A yielded area 155, shows the yielding to occur at about a 45 degree plane perpendicular to the primary shoulder 150 and extends into the first two threads of the connection. This extent of yielding may be unacceptable in any rotary shoulder connection. If the makeup torque were reduced in this standard rotary shoulder connection, the connection may not fail during make-up. However, with the reduced make-up torque, and when the 2.5 M lb. (1,135,000 kg) load is applied to standard rotary shoulder connection 148, shoulder separation may occur. Shoulder separation may occur at about 2.3 M lbs. (1,044,200 kg) when the make-up torque is reduced. One way to combat shoulder separation is to increase makeup torque. However, increased makeup torque may lead to increased bearing stress, as just previously described.

The tubular threaded connection 108 of FIG. 4C may use the increased bevel diameter Db 400, 405 of 8.078" (20.518 cm) to decrease the bearing stress between the pin shoulder 402 and the box shoulder 404 when the make-up torque is applied. Thus, even when the make-up torque of 80,000 ft-lbs. (11,070 Kg-m) is applied to reduce the risk of shoulder separation, the tubular threaded connection 108 may have acceptable levels of bearing stress as shown in FIG. 4C. The increased bevel diameter Db 400, 405 is used with the increased makeup torque to enable the threaded tubular connection to remain intact at a 2.5 M lbs. (1,135,000 kg) load.

As shown in FIG. 4C at a make-up torque of 80,000 ft-lb. (11,070 Kg-m), the tubular threaded connection 108 is not overstressed upon make-up. A high-stress cross-hatched section 455 area of the box end 124 is shown to cross a minimal portion of the box end 124. The high-stress cross-hatched section 455 area is shown on a legend 157 as being represented by the letter A. The stress level in the legend 157 decrease from A to H as shown on the legend 157 and represented on the tubular threaded connection 108 in FIG. 4C.

A finite element analysis (FEA) was conducted to analyze the contact stress at the pin shoulder 402 and the resultant contact pressure at a 2.5 M lbs. (1,135,000 kg) tensile load. The analysis was performed on the tubular threaded connection 108 with the increased bevel diameter Db 400 of 8.078" (20.518 cm), a recommended makeup torque of 80,000 ft-lbs (11,070 Kg-m), a minimum makeup torque of 78,000 ft-lbs (10,793 Kg-m), and 135,000 psi (9,450 Kg/cm2) Specified Minimum Yield Strength (SMYS) tool joints as shown in FIG. 4C. The FEA analysis shows that at a 2.5 M lbs. (1,135,000 kg) tensile load, the contact pressures at the pin shoulder 402 are 2,155 psi (150.9 Kg/cm2) and 1,006 psi (70.4 Kg/cm2) for recommended and minimum makeup torques, respectively.

Altering the bevel diameter Db 400, 405 to, for example, 8.078" (20.518 cm) may cause a problem when coupling to other tubulars, such as standard drill pipe. For example, the tubular threaded connection 108 may not be suitable for coupling directly to the Standard FH Connection. A crossover sub 470 may be used to couple the modified drill pipe segment 106 to a standard API drill pipe segment 472 as shown in FIG. 4D. The cross-over sub 470 may have one end 474 that is suited for coupling to, for example, pin end 124 of the modified drill pipe segment 106 and a second end 476 that would have the standard connection for coupling to, for example the box end 142 of the standard API drill pipe segment 472.

The modified tubular threaded connection 108 (or rotary shoulder connections (RSC)) is designed to be rugged and robust, and to withstand multiple make-up and break-out cycles. If proper running procedures are utilized, well over 100 cycles may be achieved before repair is required. Preferably, conventional drill pipe handling equipment may be used with the modified drill pipe segment 106, which accommodates relatively fast, pick-up, makeup, running and tripping speeds. Also, the use of equipment and procedures familiar to the rig crew is designed to promote safe operation.

For drilling applications, API Recommended Practice defines the drill pipe segment tensile rating (PTJ) as the cross-sectional area of the pin at the gauge point (or the pin critical area) 406 (as shown in FIG. 4A) times the SMYS of the tool joint material. The pin critical area 406 is the area that the pin end 122 may be most likely to fail when a tensile force is applied to the tubular threaded connection 108, and/or the conventional connection. For API rotary-shouldered connections (or conventional connections) the box end may be eliminated in the tool joint tensile rating where the box critical area 408 (the area of the box at the weakest point under a tensile load) is larger than the area of the pin at the gauge point (or the pin critical area) 406.

For the modified tubular threaded connection 108, the assumptions made in API RP7G for drilling applications may not be valid for landing string applications. All connection tensile parameters may be evaluated to determine the modified tubular threaded connection 108 tensile rating (or rotary-shouldered connection tensile capacity (PRCS)) comprising the pin critical area 406, the box critical area 408, the thread shear area 410, and the thread bearing area 412. For the modified tubular threaded connection 108 of the drill pipe segment 106, the design criteria for the tensile rating (PRCS) is preferably defined as greater than or equal to a pipe body tensile strength (or pipe body tensile capacity (PPB)) for 100 percent of the remaining body wall (RBW) (PPB at 100% RBW).

Another criterion to be considered for the modified tubular threaded connection 108 is the tensile load required to separate the pin shoulder 402 from the box shoulder 404. The pin shoulder 402 serves as a pressure seal for the modified tubular threaded connection 108. The sealing mechanism is generated by the compressive force between the pin shoulder 402 and the box shoulder 404 resulting from the make-up torque. During the life of the drill string 102 (as shown in FIG. 2), tensile loads may unload this compressive force. High tensile loads may result in separation of the pin shoulder 402 from the box shoulder 404 and the loss of seal therebetween. Separation of the pin shoulder 402 from the box shoulder 404 may be a function of the makeup torque, the area of the box (Ab) at the box critical area 408, the area of the pin (Ap) at the pin critical area 406, the tool joint material yield strength, and/or the amount of externally applied tensile load.

Current landing strings typically use an API Pipe OD and a thick wall that is not designated by API. The pipe joint 106 may have a designed pipe OD to wall thickness ratio. The ratio is determined by dividing the pipe OD (ODpb) 326 over wall thickness (Pbwt) 322. This ratio is typically less than or equal to 8.2. For non-landing string applications the pipe OD to wall thickness ratio is generally greater than 8.2. Ratios above 8.2 typically cannot reach the higher load capacity.

As mentioned above, the threaded tubular connection preferably meets or exceeds the load capacity of the tube by decreasing the Tool Joint ID IDtj and the Tool Joint OD ODtj and adjusting the Bevel Diameter Db. The ratio of the Bevel Diameter and the Tool Joint ID Db/IDtj may also be designed. On a Standard FH Connection, the non-modified or the typical ratios are typically below 2.21. With the increased bevel diameter Db modification, the ratio is preferably equal to or greater than about 2.21. The pipe joint 106 may have a combination of the Pipe OD/Wall ratio being ≤8.2 and the Bevel Diameter/Tool Joint ID ratio being ≥2.21.

Figure 5:
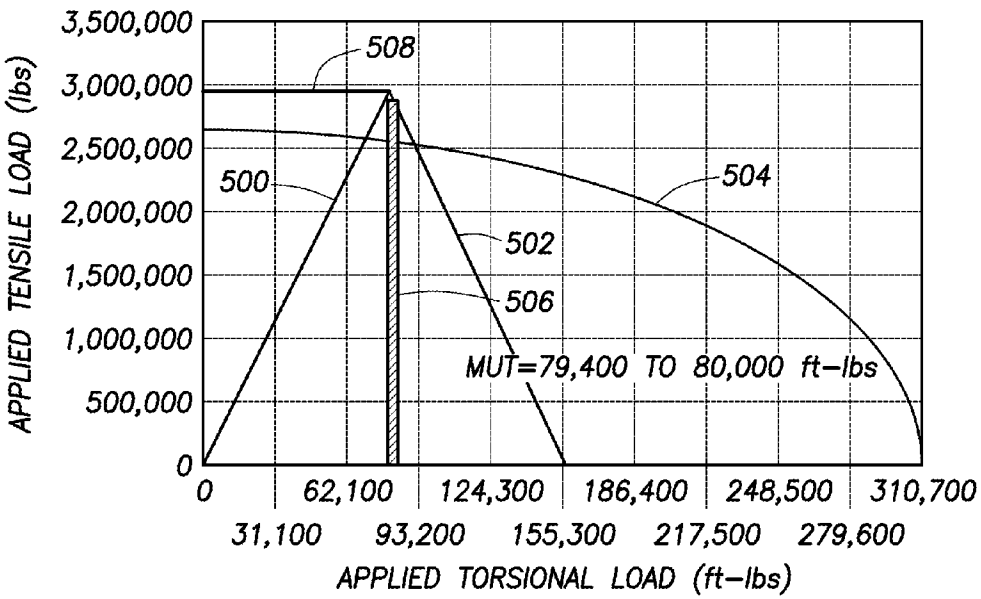
FIG. 5 is a graph depicting an applied torsional load versus an applied tensile load for the threaded tubular connection of FIG. 4C.

The design criterion for minimum shoulder separation tensile load (PSS) of the modified tubular threaded connection 108 made up to minimum MUT is defined as greater than or equal to the pipe body tensile strength (PPB) for 100 percent remaining body wall RBW (PPB at 100% RBW). FIG. 5 is a graph depicting failure of the threaded tubular connection at various applied tension (y-axis) and torsional loads (x-axis). The torque-tension chart, (FIG. 5), displays a shoulder separation 500, connection (pin) yield 502, pipe body yield 504, makeup torque range 506 and landing string rating 508 at the various loads. The equations defining the modified tubular threaded connection 108 design criteria are as follows:

$$\text{PRCS} >= \text{PPB at } 100\%\ RBW \qquad \text{(Equation 1)}$$

$$(PSS) \text{ at min. } MUT >= PPB \text{ at } 100\%\ RBW \qquad \text{(Equation 2)}$$

The Heavy-wall Slip Section

Referring now to FIGS. 2, 3A, 3B and 3D, the high capacity pipe or the modified drill pipe segment 106 may have the slip section 300 configured for engagement with slips 116. Preferably, the slip section 300 is configured to increase the overall capacity of the drill string 102. The slip section 300 is preferably configured to prevent the slips 116 from crushing the drill pipe segment 106 of the drill string 102 when a high load is applied to the slips 116. When the slips 116 are placed on the drill string 102 to support the drill string 102 on the rotary table, the slips 116 may exert a radial force on the drill pipe segment 106. This radial force on the drill pipe segment 106 may create a collapse force inducing a hoop stress. With the increasing axial load, the hoop stress increases. The slip-crushing capacity (PSCC) may be less than the tubular tensile capacity in standard drill strings. The slip-crushing capacity (PSCC) may be dependent on the pipe body OD, the wall thickness, and the pipe material proximate the location of the slips 116 engaging the drill pipe segment 106. The modified drill pipe segment 106 may have the slip section 300 configured to prevent the slips 116 from crushing the drill pipe segment 106.

The slip section 300 is the part of the drill pipe segment 106 that is most likely to be in contact with the slips 116 during drilling operations. As shown in FIGS. 3A and 3B, the slip section 300 may be a portion of the drill pipe segment 106 located adjacent the box end 124 of the modified drill pipe segment 106. Thus, the slip section 300 may be located between the tool joint 304 of the box end 124 and the pipe body 302. In one example, the slip section 300 may extend between 50" (127 cm) and 100" (254 cm) below the tool joint 304. In yet another example, the slip section 300 may extend between approximately 70" (177.8 cm) and 80" (203.2 cm) below the tool joint 304. In yet another example, the slip section 300 may extend approximately 74" (187.96 cm) from the tool joint 304.

The slip section 300 may be provided with a slip section wall thickness (SSWt) 320 that is greater than the pipe body wall thickness (PBWt) 322. The increased slip section wall thickness (SSWt) 320 may increase the slip load capacity of the drill pipe segment 106. The slip section 300 may increase the elevator capacity of the tool joint 304, while not requiring the entire length of the pipe body 302 to have the increased elevator capacity. Although the slip section 300 is shown as extending only a portion of the length of the drill pipe segment 106, the slip section 300 may extend the entire length of the pipe body 302. This configuration may be used to alleviate the need to change the wall thickness of the drill pipe segment 106 between the slip section 300 and the pipe body 302.

The slip section 300 may provide a thicker wall in the slip-contact area. In addition to a heavier wall, the slip section 300 may have machined OD and ID surfaces. The machined OD and ID surfaces of the slip section 300 may provide improved concentricity and ovality of the drill pipe segment. The concentricity and ovality may also increase slip-crushing resistance.

One or more slip inserts 133 (as shown in FIG. 2) may be designed to bite into the slip section outer diameter (SSOD) 324 surface of the drill pipe segment 106 (see FIG. 3A). The slip inserts 133 may secure the drill pipe segment 106 while the adjacent drill pipe segment 106 is made up or broken out. Slip cuts caused by the slip inserts 133 in the SSOD 324 surface may produce stress risers, and are typically located near the box end 124 of the drill pipe segment 106 at the transition between the slip section 300 and the modified tool joint 304. The slip section 300 preferably increases the life of the drill pipe segment 106 by providing increased wall thickness in this high stress, fatigue prone area.

The slip-crushing capacity PSCC may also be dependent on the contact area of the slip-inserts and the transverse load factor for the slips 116 (as shown in FIG. 2). The transverse load factor relates the vertical load supported by the slips 116 (string weight) to the radial load imposed by the slip-inserts on the slip section 300 (as shown in FIG. 3A). The transverse load factor is dependent on the friction between the slips 116 and a bowl 135 (as shown in FIG. 2). The specific slip design varies with different slip models and manufacturers.

A slip section outer diameter SSOD 324 may be equal to a pipe body outer diameter (PBOD) 326 (as shown in FIG. 3A) in order to use a standard elevator bushings 137 (as shown schematically in FIG. 2). A slip section inner diameter (SSID) 328 may be limited by maximum area of the friction welds that join the slip section 300 to the pipe body 302 and to the tool joint 304. For the Modified FH Connection, the PBOD and the SSOD may equal 6.906" (17.541 cm) and the minimum SSID 328 of the slip section 300 may be 3.500" (8.89 cm).

A material with a SMYS of 155,000 psi (10,850 Kg/cm2) may be required for the slip-crushing capacity of the slip section 300 to equal or exceed the tensile capacity of the pipe body 302. Due to the 48" (121.92 cm) length limitation of a typical friction welder, the slip section may be made from two parts. One part, or section, may be plain ended and one section may be integral with the box end 124 of the tool joint 304, as shown in FIG. 3A. Since the impact of the higher strength material on the fatigue resistance of the threaded tubular connection 108, or the RSC, may not be known, a plain-end section 301 (as shown in FIG. 3A) of the slip section 300 may be made from the 155,000 psi (10,850 Kg/cm2) SMYS material and an integral slip section box tool joint section 303 may be made of 135,000 psi (9,450 Kg/cm2) SMYS material. Further, it should be appreciated that both the tool joint 304 and the slip section 300 may use the 155,000 psi (10,850 Kg/cm2) SMYS material. The drill pipe segment 106, for example, may have a material that has 135,000 psi (9,450 Kg/cm2) SMYS with a tool joint outer diameter ODtj 330 of 8.688" (22.067 cm) and a tool joint inner diameter IDtj 317 of 3.500" (8.89 cm). With this material yield strength and these dimensions, the recommended makeup torque is about 80,000 ft-lbs (11,070. Kg-m) and the minimum makeup torque is about 78,000 ft-lbs (10,793 Kg-m).

The Tool Joint

The high capacity pipe, or the modified drill pipe segment 106, may be provided with the modified tool joint 304 as shown in FIG. 3A and 3B. In order to provide a constant ID thoughout the slip section 300 and the tool joint 304, an inner diameter of the tool joint (IDtj) may equal the box end connection inner diameter IDbc 318 (as shown in FIG. 3A) and the slip section inner diameter SSID 328.

A balanced tool joint configuration may be desired to maximize the fatigue resistance and provide torsional balance for the modified threaded tubular connection 108, and minimize the required makeup torque (MUT). The design criterion for a balanced configuration may be defined as the ratio of the area of the box (AB) divided by the area of the pin (AP). Preferably, this ratio is in the range of about 1.00 to 1.15. The area of the pin AP (or the pin critical area) 406 is the cross-sectional area of the pin end 122 at a distance of 0.750" (1.905 cm) from the pin shoulder 402. The area of the box AB (or the box critical area) 408, is the cross-sectional area of the box end 124 at a distance of 0.375" (0.953 cm) from the box shoulder 404. The criterion range provides some additional box material to facilitate wear of the tool joint outer diameter (ODtj) 330 during use.

The tool joint outer diameter (ODtj) 330 (FIG. 3A) may also be critical in determining the elevator capacity of the drill string 102. The elevator capacity may be the product of the horizontal projected contact area of a tapered tool joint shoulder 332 (or elevator shoulder) (as shown in FIG. 3A) against the elevator bushings 137 (as shown in FIG. 2) times the lesser compressive yield strength of the two contact surfaces. Typically, the elevator bushing 137 has the lower yield strength of the two components. For example, the elevator bushing may have a yield strength of 110,100 psi (7,707 Kg/cm2) verses 120,000 psi (8,400 Kg/cm2) or higher for the tool joint 304. The design criteria may define the minimum elevator capacity, without wear factor for the elevator bushing 137, as greater than or equal to the pipe body tensile strength (PPB) for 100 percent RBW (PPB at 100% RBW). Elevator capacity curves can be generated to determine the reduction in lift capacity from tool joint OD wear. Thus, the contact area of the tapered tool joint shoulder 332 (or elevator shoulder) with the elevator bushing 137 may play an important role in the capacity of the drill string 102 (as shown in FIG. 2).

Figure 6:
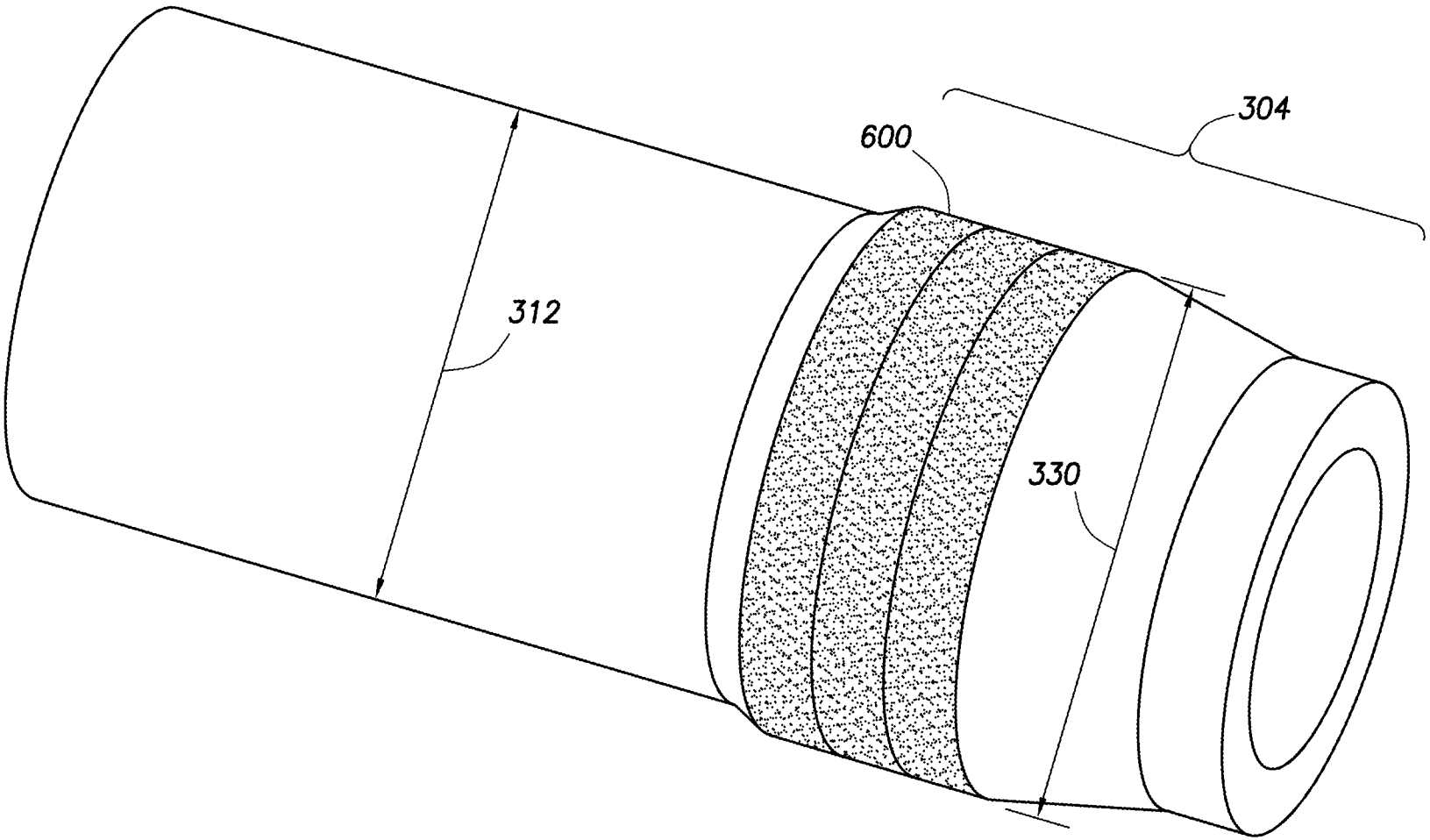
FIG. 6 shows a schematic view of a portion of the modified drill pipe segments of FIG. 2 provided with hardbanding.

To meet two differing outer diameter criteria of the tool joint 304, such as a balanced configuration and the elevator capacity, a dual-diameter tool joint 304 may be employed as shown, for example, in FIGS. 3A and 3B. The dual outer diameter tool joint 304 may provide a sacrificial wear pad for the installation of a casing-friendly hardband material located in a hardband zone 600 as shown in FIG. 6. The dual outer diameter feature may permit the hardband zone 600 (or the tool joint outer diameter (ODtj) 330) to protrude further than the outer diameter of the primary tool joint diameter, or the box end connection outer diameter (ODbc) 312.

For the drill string 102 (as shown in FIG. 2), the dual-diameter tool joint 304 provides one diameter to meet the balanced configuration (AB/AP) requirement and provide for fishing needs, and a larger second diameter to meet the elevator capacity requirement. The equations defining the tool joint design criteria are as follows:

(IDTJ)=inner diameter of the slip section (IDHWSS) (Equation 3)

$1.0<=AB/AP<=1.15$ (Equation 4)

$PEC>=PPB$ at 100% $RBW$ (Equation 5)

Elevator capacity (PEC) may be calculated from the projected area of the tool joint 304 that is in contact with the elevator bushing 137 and the compressive yield strength of the elevator bushing 137 (FIG. 2). As mentioned above, a dual radius tool joint preferably provides a balanced connection and adequate elevator capacity. For the Modified Standard FH Connection an outer diameter of 8.688" (22.067 cm) may be selected for box end outer diameter (ODbc) 312 as discussed above. This (ODbc) 312 may result in a balanced connection with an area of the box to area of the pin AB/AP ratio of about 1.06. The standard elevator bushing 137 compressive strength value may be about 110,100 psi (7,007 Kg/cm2). This results in the tool joint outer diameter (ODtj) 330 adjacent to the taper being equal to about 9.125" (23.178 cm) for the elevator capacity to equal the tensile rating of 6-⅝ inches (16.83 cm), 1.000" (2.54 cm) wall thickness, UD-165 pipe. Where the inner diameter (ID) of the friction welder spindle is 9 inches (22.86 cm), the maximum tool joint outer diameter (ODtj) may be limited to about 8.875" (22.54 cm). Although, this may not meet the preferred design criteria, fortunately this does provide elevator capacity in excess of the 2.5 M lbs (1,135,000 kg) rating. The tapered tool joint shoulder 332 (or elevator shoulder) may be increased from the standard 18 degrees to about 45 degrees to accommodate a high capacity elevator bushing 137.

The high capacity drill pipe (or the modified drill pipe segment) 106 may be provided with welds 306 as shown in FIG. 3A and 3B to increase the capacity of the drill pipe segment 106. There may be manufacturing limitations that affect the design particularly related to the friction weld process. The maximum friction-weld yield strength with the standard manufacturing practices is generally limited to about 110,000 psi (7,700 Kg/cm2). However, by controlling and matching the alloys of the welded components, weld yield strengths may be increased to above about 125,000 psi (8,750 Kg/cm2). The design criteria for the weld may be defined as the minimum weld tensile capacity (PWELD min) equal to or greater than 110 percent of the pipe body 302 tensile capacity for 100 percent RBW.

Equations defining certain manufacturing design considerations are as follows:

$PWELD$ min>=1.1* $PPB$ at 100% RBW (Equation 6)

Maximum weld yield strength<=110,000 psi (7,700 Kg/cm2) standard or 125,000 psi (8,750 Kg/cm2) for matched alloys (Equation 7)

The weld strength may be limited by the alloy composition of the two mated components. For a 2.5 M lbs. (1,135,000 kg.) landing string, the expected weld yield strength may be about 125,000 psi (8,750 Kg/cm2) or higher. The weld area may be defined by the dimensions of the slip section 300, or approximately 6.906" (17.541 cm) outer diameter by 3.500" (8.89 cm) inner diameter. The required weld yield strength calculates to 122,657 psi (8,585 Kg/cm2), which is below the 125,000 psi (8,750 Kg/cm2) minimum and is, therefore, typically acceptable.

The slip section 300 may be designed with two welds 306. A first weld 306 may be at the intersection between the slip section 300 and the modified tool joint 304. A second weld may be at the intersection between the pipe body 302 and the slip section 300. Further, there may be a weld 306 between the pin end 122 and the pipe body 302. For welding, the drill pipe segment 106 and/or the slip section 300, the material is preferably compatible with the pipe body 302, the pin end 122 and the tool joint 304. The standard drill pipe segment may be made from quenched and tempered mechanical tubing with a SMYS of about 120,000 psi (8,400 kg/cm2). Alternatively, high yield strength material may be used when required for increased PSCC.

The high capacity pipe (or the modified drill pipe segment) 106 may include the pipe body 302 as shown in FIG. 3A and 3B configured to increase the capacity of the drill pipe segment 106. The drill string 102 (as shown in FIG. 2) design criteria may be based on assuring that the pipe body 302 is the weakest component in the drill string 120. This allows the pipe body 302 to yield to prevent the threaded tubular connection 108, the welds 306, or the tool joint 304 from experiencing a catastrophic failure. This may be important in cases where the slips 116 and elevator capacities exceed the drill string's 102 tensile capacity. The tensile capacity (PPB) of the pipe body 302 is defined as the pipe body yield (YPB) at the SMYS (or grade) times the pipe body cross-sectional area. The cross-sectional area increases more with increased pipe OD than with decreased pipe inside diameter (ID) or increased wall thickness. This, plus the improved hydraulics for circulating and cementing with a larger ID, indicates that the largest pipe diameters possible may be used. However, if possible, there may be benefit from matching the drill pipe segment 106 diameter to the drill pipe diameter (not shown) used for the drilling operations, thereby mitigating the need to change pipe handling and make-up equipment.

The pipe body outer diameter (ODpb) 326, the pipe body wall thickness (PBWt) 322 and the material of the pipe body 302 may determine the strength of the pipe body. For example, for a 6-⅝" (16.83 cm) diameter V-150 grade pipe, the (PBwt) 322 of 1.125" (2.857 cm) is required for the pipe body 302 tensile rating at 90% RBW to meet the 2.5 M lbs (1,135,000 kg) rating. By utilizing about a 165,000-psi (11,550 Kg/cm2) SMYS pipe, the pipe body wall thickness (PBWt) 322 may be reduced to about 1.000" (2.54 cm) resulting in about a 5 percent decrease in string weight. Although, for a Modified FH Connection a 1.000" (2.54 cm) pipe body wall thickness, range 3 (having a length between about 40' (12.19 m) and about 45' (13.71 m)) pipe was the preferred choice for the 2.5 M lbs (1,135,000 kg) landing string, due to supply chain logistics a Modified FH Connection drill pipe segment with a 0.938" (2.382 cm) pipe body wall thickness range 2 (having a length between about 30' (9.144 m) and about 32' (9.75 m)) may be used. The drill string 102 may be manufactured to a 95 percent RBW requirement. An ongoing inspection requirement of 92 percent RBW will be required for the drill string to maintain a 2.5 M lbs (1,135,000 kg) rating.

The drill string 102 (as shown in FIG. 2) may be a considerable capital investment in the drilling operation. It may be desirable to consider the options available to extend the useful life of the drill string. The hardbanding zone 600 of the tool joint 304 may prevent wear of the tool joint OD in the event that the string must be rotated, as shown in FIG. 6. Extra-long tool joints with extended tong space may provide for additional repair or rethreading of the threaded tubular connection 108 or (RSC) to increase the useful life of the drill pipe segment 106. Finally, internal plastic coatings may mitigate corrosion of the drill pipe segment 106 inner diameter from drill fluids and/or facilitate reduced friction during fluid flow.

The high capacity pipe (or the modified drill pipe segments 106) may have one or more features that increase the loading capacity of the drill string 102, as shown for example in FIG. 2. The bevel diameter (Db) 400 may be increased. The increased bevel diameter (Db) allows the make-up torque to be increased thereby preventing shoulder separation when the drill string 102 is loaded with up to about 2.5 M lbs (1,135,000 kg). The drill pipe segment 106 may include the slip section 300 configured to increase the slip crushing capacity of the drill string 102. The drill pipe segment 106 may have a duel outer diameter tool joint 304 on the box end 124 and the pin end 122. The dual diameter tool joint 304 may allow the threaded tubular connection 108 to balance the tool connection while increasing the elevator capacity. The drill pipe segment 106 may have one or more welds configured to maximize the capacity of the drill string 102. The drill pipe segments 106 may have the pipe body 302 that is designed and/or sized to be the weakest point in the drill string 102. Various combinations of one or more of these features may allow the drilling operations to reach at least the 2.5 M lb. (1,135,000 kg) mark.

The drill string 102 (or the landing string) bevel aspects of the invention may comprise, inter alia, an enlargement of the bevel diameter (Db) 400 on the connections (or tubular threaded connection) 108. The enlarged bevel diameter allows for the application of extreme loads as seen in landing string applications. Aspects of the invention can be implemented with conventional connection configurations. Aspects of the invention may be particularly useful on drill pipe that exceeds 2.0M lbs (908,000 kg.) in tensile capacity. This modification may be needed in order to overcome the high bearing stress on the counterbore area caused by the increase in MUT that may be needed to prevent shoulder separation.

Figure 7:
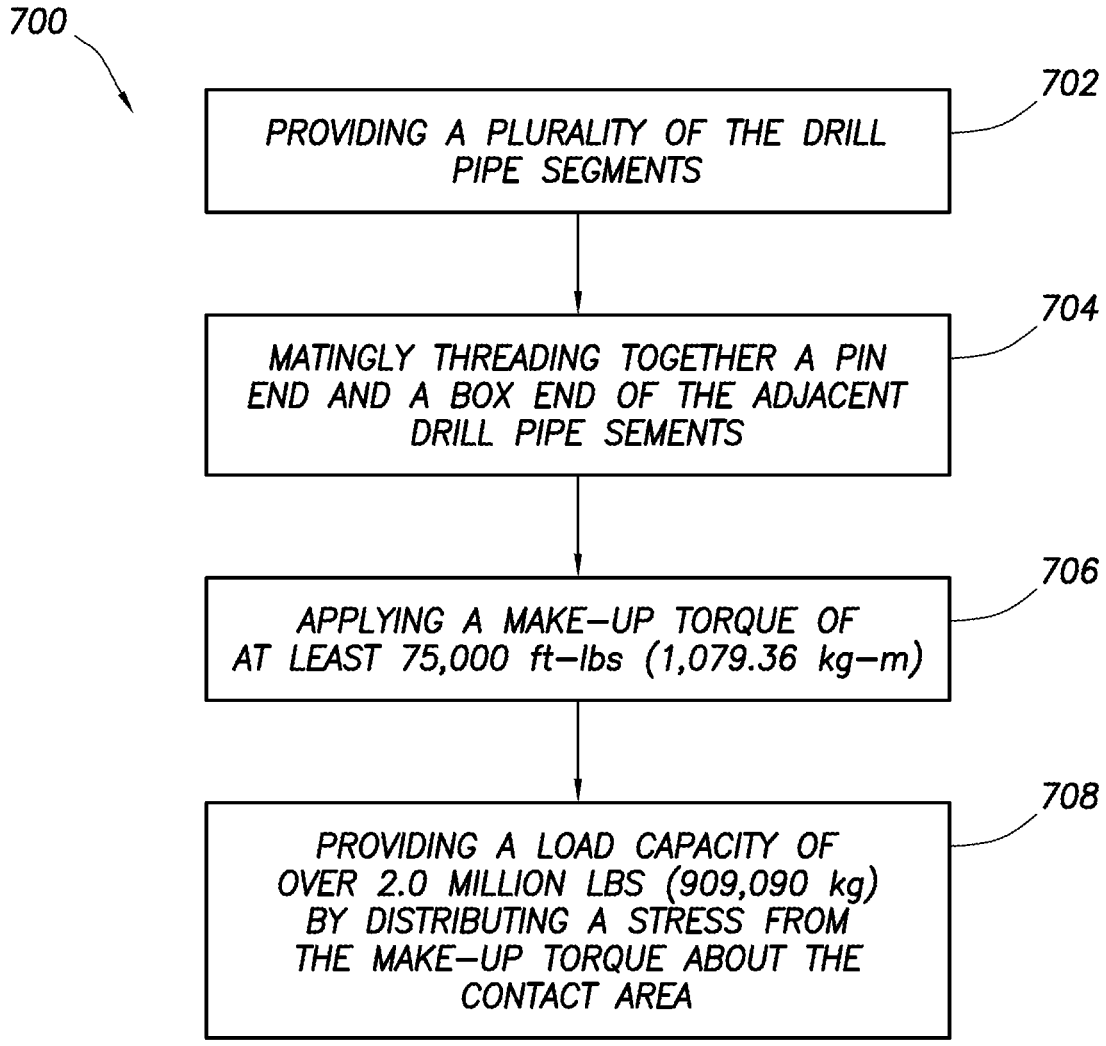
FIG. 7 shows flow chart depicting a method for forming a threaded connection of the drill string of FIG. 2.

FIG. 7 is a flow chart 700 depicting a method for using the modified drill pipe segments. The method provides 702 a plurality of the drill pipe segments. Next, the method continues by matingly threading 704 together a pin end and a box end of adjacent drill pipe segments. The method continues by applying 706 a make-up torque of at least 75,000 ft-lbs (1,079.36 kg-m) to the uppermost of the drill pipe segments and providing 708 a load capacity of over 2.0 million lbs by distributing a stress from the make-up torque about the contact area.

It will be appreciated by those skilled in the art that the oilfield operation systems/processes disclosed herein can be automated/autonomous via software configured with algorithms to perform operations as described herein. The aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a magnetic tape; a read-only memory chip (ROM); and other forms of the kind well-known in binary form that is executable more-or-less directly by the computer; in "source code" that requires compilation or interpretation before execution; or in some intermediate form such as partially compiled code. The precise forms of the program storage device and of the encoding of instructions are immaterial here. It will also be understood by those of ordinary skill in the art that the disclosed structures can be implemented using any suitable materials for the components (e.g., metals, alloys, composites, etc.) and conventional hardware and components (e.g., conventional fasteners, motors, etc.) can be used to construct the systems and apparatus.

While the present disclosure describes specific aspects of the invention, numerous modifications and variations will become apparent to those skilled in the art after studying the disclosure, including use of equivalent functional and/or structural substitutes for elements described herein. For example, aspects of the invention can also be implemented for non-oilfield applications using connections/joints susceptible to high loading. All such similar variations apparent to those skilled in the art are deemed to be within the scope of the invention.

What is claimed is:

1. A tubular threaded connection for coupling adjacent drill pipe segments together to form a drill string, each of the drill pipe segments having a tubular pipe body having a first end and a second end and a passage therethrough, the tubular pipe body having a wall thickness of at least 0.5 inches (12.7 cm), the drill string supported by a drilling rig for advancing a downhole tool into the earth to form a wellbore, the tubular threaded connection comprising:

a pin end of a first of the adjacent drill pipe segments, the pin end having an external thread on an outer surface thereof, the outer surface of the pin end extending from the first end of the first of the adjacent drill pipe segments and terminating at a pin shoulder a distance from the first end; and a box end of a second of the adjacent drill pipe segments, the box end having an internal thread on an inner surface thereof for threadable engagement with the external thread of the pin end, the inner surface of the box end extending from the second end of the second of the adjacent drill pipe segments and terminating at a box shoulder a distance from the second end;

wherein the pin shoulder extends between a pin base diameter and an outer pin bevel diameter of the first of the adjacent drill pipe segments and the box shoulder extends between a box counterbore diameter and an outer box bevel diameter of the second end of the adjacent drill pipe segments, the outer pin bevel and the outer box bevel diameters being smaller than an outer diameter of the pin end, the outer pin bevel diameter and the outer box bevel diameter being between 7.75 and 8.688 inches (19.05-21.59 cm), the pin base diameter being smaller than the outer pin bevel diameter and the box counterbore diameter being smaller than the outer box bevel diameter, the pin and box shoulders defining a contact area therebetween such that, when the pin end and the box end are matingly threaded together with a make-up torque of at least 75,000 ft-lbs (1,079.36 kg-m), the drill string is formed having a plurality of tubular pipe bodies having a wall thickness of at least 0.5 inches (12.7 cm) and a tensile load capacity of over 2.0 million lbs (908,000 kg).

2. The tubular threaded connection of claim 1, wherein the outer pin bevel diameter and the outer box bevel diameter is between 8.0" and 8.1" (20.32-20.574 cm).

3. The tubular threaded connection of claim 1, wherein the box end of each of the adjacent drill pipe segments has a dual outer diameter.

4. The tubular threaded connection of claim 3, wherein the box end of each of the adjacent drill pipe segments has a constant inner diameter.

5. A drill pipe segment for forming a tubular threaded connection with an adjacent drill pipe segment to form a drill string, the drill string supported by a drilling rig for advancing a downhole tool into the earth to form a wellbore, the drill pipe segment comprising:

a tubular pipe body having a first end and a second end and a passage therethrough, the tubular pipe body having a wall thickness of at least 0.5 inches (12.7 cm);

a pin end at a first end of the tubular pipe body, the pin end having an external thread on an outer surface thereof, the outer surface of the pin end extending from the first end of the tubular pipe body and terminating at a pin shoulder a distance from the first end; and a box end at a second end of the tubular pipe body, the box end having an internal thread on an inner surface thereof for threadable engagement with the external thread of the pin end, the inner surface of the box extending from the second end of the tubular pipe body and terminating at a box shoulder a distance from the second end;

wherein the pin shoulder extends between a pin base diameter and an outer pin bevel diameter of the pin end and the box shoulder extends between a box counterbore diameter and an outer box bevel diameter of the box end. the outer pin bevel diameter and the outer box bevel diameter being smaller than an outer diameter of the pin end, the outer pin bevel diameter and the outer box bevel diameter being between 7.75 and 8.688 inches (19.05-21.59 cm), the pin base diameter being smaller than the outer pin bevel diameter and the box counterbore diameter being smaller than the outer box bevel diameter, the pin shoulder and the box shoulder defining a contact area therebetween such that, when the pin end and the box end of the adjacent drill pipe segments are matingly threaded together with a make-up torque of at least 75,000 ft-lbs (1,079.36 kg-m), the drill string is formed having a plurality of tubular pipe bodies having a wall thickness of at least 0.5 inches (12.7 cm) and a tensile load capacity of over 2.0 million lbs (908,000 kg).

6. The drill pipe segment of claim 5, wherein the box end further comprises a first outer diameter and a second larger outer diameter.

7. The drill pipe segment of claim 6, wherein the second larger outer diameter is proximate an elevator shoulder located between the box end and the pipe body.

8. The drill pipe segment of claim 7, wherein the pipe body further comprises a slip section, wherein the slip section is located proximate the elevator shoulder and defines a slip section outer diameter which is larger than a pipe body outer diameter.

9. The drill pipe segment of claim 8, wherein the slip section further defines a slip section inner diameter which is smaller than a pipe body inner diameter.

10. The drill pipe segment of claim 9, wherein the slip section outer diameter and the slip section inner diameter are machined surfaces.

11. The drill pipe segment of claim 10, wherein the machined surfaces are for reducing stress caused by at least one slip insert engaging the slip section.

12. The drill pipe segment of claim 5, wherein the outer pin bevel diameter is between 8.0" and 8.1" (20.32-20.574 cm).

13. The drill pipe segment of claim 5, further comprising a hardened zone on an outer surface of the box end.

14. The drill pipe segment of claim 5, further comprising at least one weld.

* * * * *